US005546710A

United States Patent [19]

Barry

[11] Patent Number: 5,546,710

[45] Date of Patent: Aug. 20, 1996

[54] CUSTOMIZED MEMORIAL

[76] Inventor: David J. Barry, 6032 N. Hamburg Rd., Oldenburg, Ind. 47036

[21] Appl. No.: 421,525

[22] Filed: Apr. 13, 1995

[51] Int. Cl.[6] ..... E01F 9/011

[52] U.S. Cl. ..... 52/104; 52/157

[58] Field of Search ..... 52/103, 104, 157, 52/155

[56] References Cited

U.S. PATENT DOCUMENTS 1,397,483 11/1921 Brown ..... 52/103

4,899,498 2/1990 Grieb ..... 52/157 X 5,113,627 5/1992 Jarrett, Sr. ..... 52/157

*Primary Examiner*—Carl D. Friedman

*Assistant Examiner*—Creighton Smith

[57] ABSTRACT

A customized memorial comprised of a base portion having a recess formed therein. A pair of auger-style anchors secure the base portion into a ground area. A monument is adapted to be received within the recess in the base portion.

5 Claims, 3 Drawing Sheets

CUSTOMIZED MEMORIAL

BACKGROUND OF THE INVENTION

1. Field of the Invention

The present invention relates to a customized memorial and more particularly pertains to providing a graveside memorial with a customized memorial.

2. Description of the Prior Art

The use of gravemarkers is known in the prior art. More specifically, gravemarkers heretofore devised and utilized for the purpose of combining with other functions to mark a gravesite are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 305,876 to Gewinner discloses a headstone floral holder.

U.S. Pat. No. 5,072,542 to Quackenbush discloses a gravestone saddle planter.

U.S. Pat. No. 5,252,893 to Chacham et al. discloses a light flasher apparatus.

U.S. Pat. No. 4,722,160 to Davis discloses a combination grave marker and flower receptacle.

U.S. Pat. No. 4,463,527 to Schlosser discloses a grave marker for memorial.

U.S. Pat. No. 4,631,859 to Letter et al. discloses an integral grave marker and flower receptacle.

While these devices fulfill their respective, particular objective and requirements, the aforementioned patents do not describe a customized memorial for providing a graveside memorial.

In this respect, the customized memorial according to the present invention substantially departs from the conventional concepts and designs of the prior art, and in doing so provides an apparatus primarily developed for the purpose of providing a graveside memorial.

Therefore, it can be appreciated that there exists a continuing need for new and improved customized memorial which can be used for providing a graveside memorial. In this regard, the present invention substantially fulfills this need.

SUMMARY OF THE INVENTION

In the view of the foregoing disadvantages inherent in the known types of gravemarkers now present in the prior art, the present invention provides an improved customized memorial. As such, the general purpose of the present invention, which will be described subsequently in greater detail, is to provide a new and improved customized memorial and method which has all the advantages of the prior art and none of the disadvantages.

To attain this, the present invention essentially comprises a base portion having a top side, a bottom side, a front wall, a rear wall, and two side walls. The top side has a recess formed therein. The recess has a bottom side, a front side, a rear side, and two sides. The bottom side of the recess has apertures formed through opposing ends thereof extending through the bottom side of the base portion. The rear side and the front side of the recess each have apertures formed through opposing ends thereof extending through the respective front wall and rear wall of the base portion. The device contains a pair of auger-style anchors being adapted for receipt through the apertures through opposing ends of the bottom side of the recess and extending outwardly of the bottom side of the base portion. The pair of auger-style anchors secure the base portion into a ground area. The device contains a monument having an upper end, a lower end, a front wall, a rear wall, and two side walls. The monument has a pair of apertures formed through the front wall and extending through the rear wall adjacent to the lower end thereof. The lower end of the monument is adapted to be received within the recess in the base portion. The pair of apertures align with the apertures formed in the rear side and front side of the recess thus permitting the monument to be secured to the base portion by nuts and bolts through the aligning apertures. The front wall of the monument has a rectangular indented area therein downwardly of the upper end. The front wall has a plurality of recessed portions formed therein downwardly of the rectangular indented area. The front wall has two square indented areas therein downwardly of the plurality of recesses portions. The device contains a plurality of clear plastic enclosure inserts adapted for securement within the plurality of recessed portions formed in the front wall of the monument.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved customized memorial which has all the advantages of the prior art gravemarkers and none of the disadvantages.

It is another object of the present invention to provide a new and improved customized memorial which may be easily and efficiently manufactured and marketed.

It is a further object of the present invention to provide a new and improved customized memorial which is of durable and reliable construction.

An even further object of the present invention is to provide a new and improved customized memorial which is susceptible of a low cost of manufacture with regard to both materials and labor, and which accordingly is then susceptible of low prices of sale to the consuming public, thereby making such a customized memorial economically available to the buying public.

Still yet another object of the present invention is to provide a new and improved customized memorial which provides in the apparatuses and methods of the prior art some of the advantages thereof, while simultaneously overcoming some of the disadvantages normally associated therewith.

Even still another object of the present invention is to provide a new and improved customized memorial for providing a graveside memorial.

Lastly, it is an object of the present invention to provide a new and improved customized memorial comprised of a base portion having a recess formed therein. A pair of auger-style anchors secure the base portion into a ground area. A monument is adapted to be received within the recess in the base portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
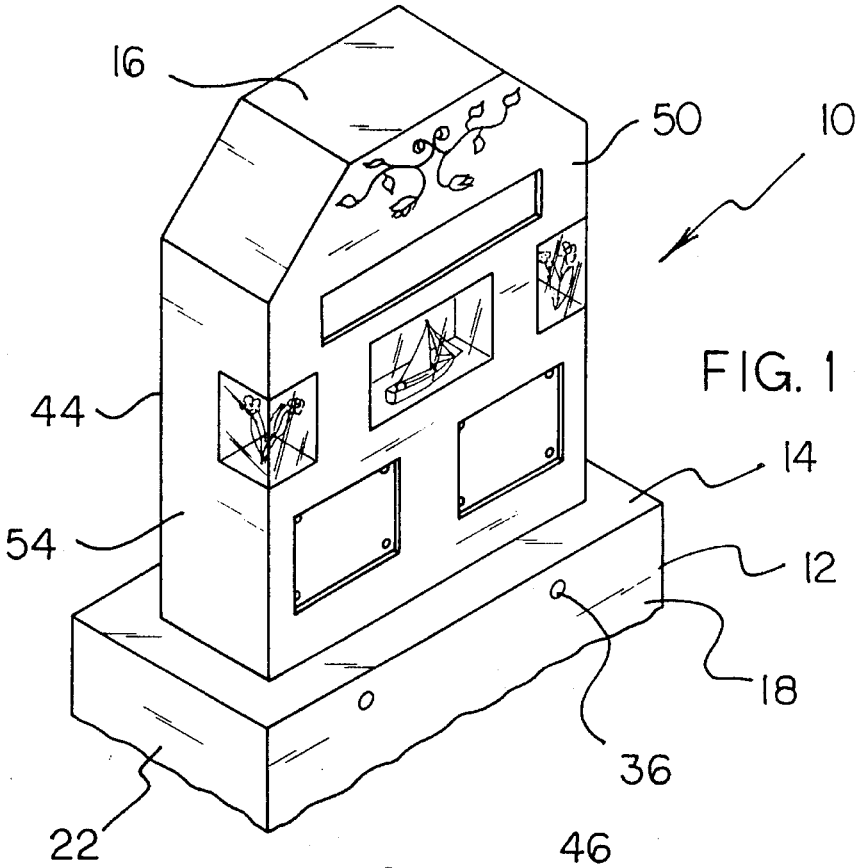
FIG. 1 a perspective view of the preferred embodiment of the customized memorial constructed in accordance with the principles of the present invention.
Figure 2:
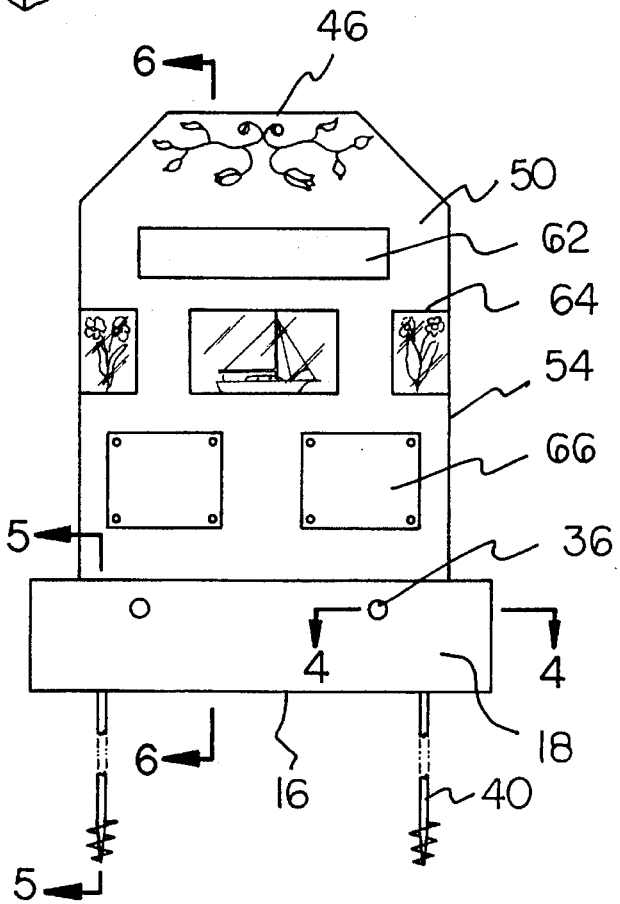
FIG. 2 is a front elevation view of the present invention.
Figure 3:
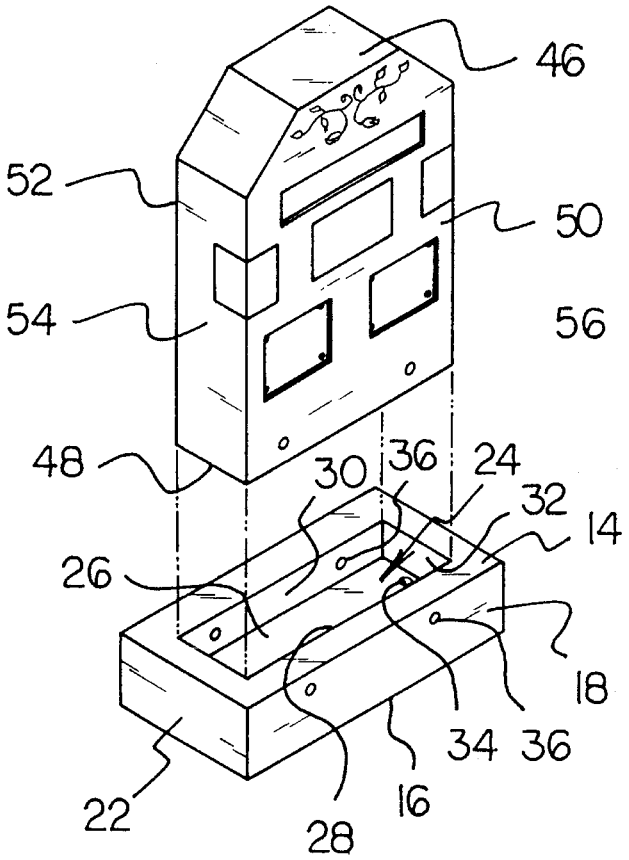
FIG. 3 is a perspective view of the monument disassembled from the base.
Figure 4:
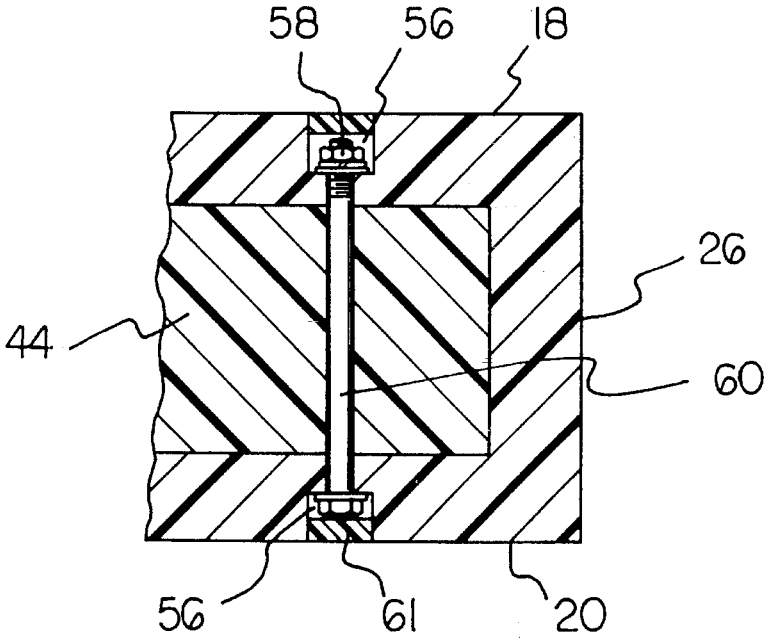
FIG. 4 is a cross-sectional view as taken along line 4—4 of FIG. 2.
Figure 5:
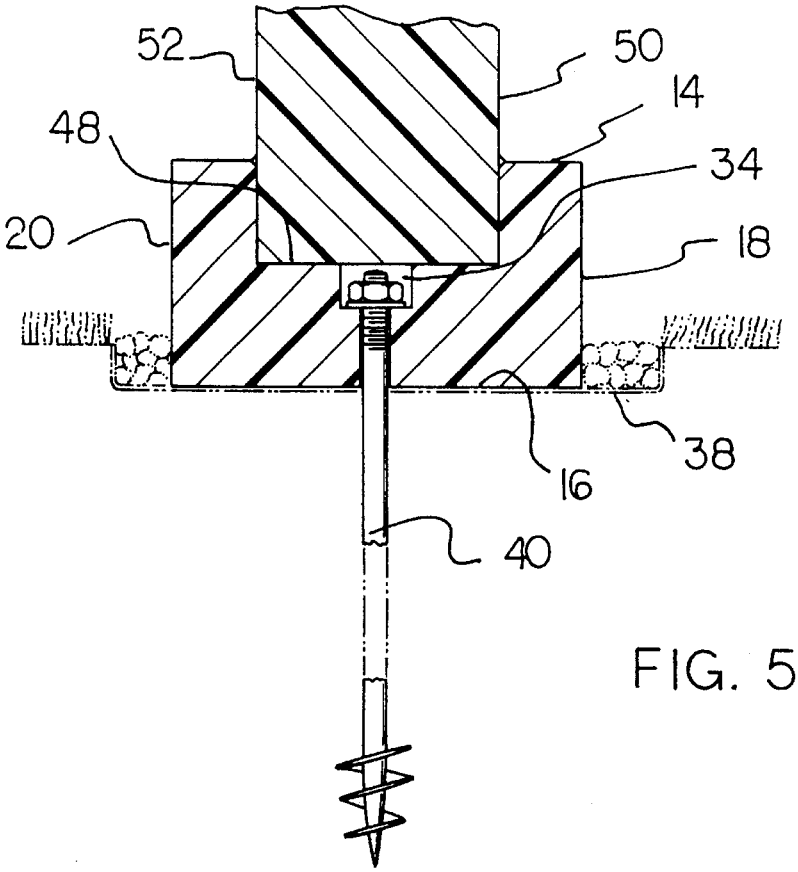
FIG. 5 is a cross-sectional view as taken along line 5—5 of FIG. 2.
Figure 6:
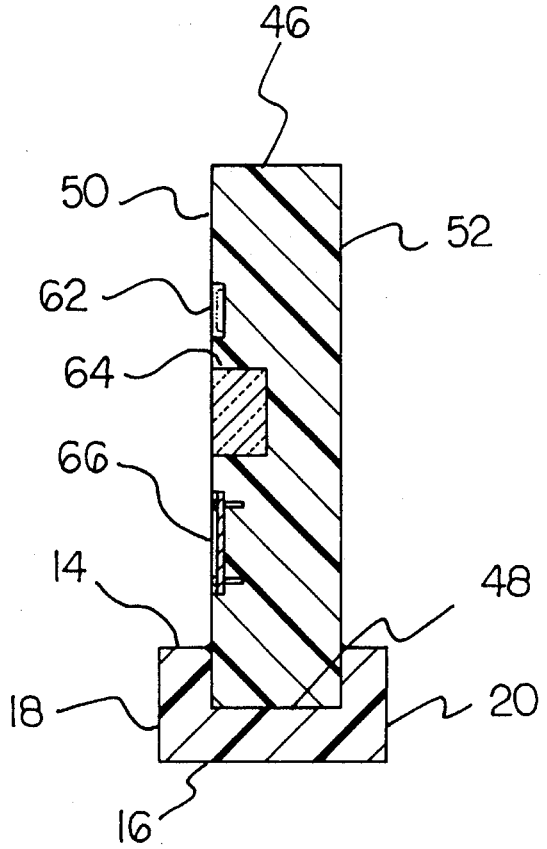
FIG. 6 is a cross-sectional view as taken along line 6—6 of FIG. 2.

With reference now to the drawings, and in particular, to FIGS. 1–6 thereof, the preferred embodiment of the new and improved customized memorial embodying the principles and concepts of the present invention and generally designated by the reference number 10 will be described.

Specifically, it will be noted in the various Figures that the device relates to a new and improved customized memorial for providing a graveside memorial. In its broadest context, the device consists of a base portion, a pair of auger-style anchors, a monument, and a plurality of clear plastic enclosure inserts.

The device 10 contains a base portion 12 having a top side 14, a bottom side 16, a front wall 18, a rear wall 20, and two side walls 22. The top side 14 has a recess 24 formed therein. The recess 24 has a bottom side 26, a front side 28, a rear side 30, and two sides 32. The bottom side 26 of the recess 24 has apertures 34 formed through opposing ends thereof extending through the bottom side 16 of the base portion 12. The rear side 30 and the front side 28 of the recess 24 each have apertures 36 formed through opposing ends thereof extending through the respective front wall 18 and rear wall 20 of the base portion 12. After dirt and sod are cleared away from a desired area and the area is leveled, a plastic sheet 38 is placed down within the cleared away and leveled area and the base portion 12 is positioned on top of the plastic sheet 38.

The device 10 contains a pair of auger-style anchors 40 being adapted for receipt through the apertures 34 through opposing ends of the bottom side 26 of the recess 24 and extending outwardly of the bottom side 16 of the base portion 12. The pair of auger-style anchors 40 secure the base portion 12 into a ground area. The auger-style anchors 40 are similar to those used to secure mobile homes and could be placed into the ground to a depth of thirty-six to forty-eight inches.

The device 10 contains a monument 44 having an upper end 46, a lower end 48, a front wall 50, a rear wall 52, and two side walls 54. The monument has a pair of apertures 56 formed through the front wall 50 and extending through the rear wall 52 adjacent to the lower end 48 thereof. The lower end 48 of the monument is adapted to be received within the recess 24 in the base portion 12. The pair of apertures 56 align with the apertures 36 formed in the rear side 30 and front side 28 of the recess 24 thus permitting the monument 44 to be secured to the base portion 12 by nuts 58 and bolts 60 through the aligning apertures 56,36. The nuts 58 and bolts 60 are extended within the apertures 56 in the front wall 50 and the rear wall 52 and covered by plastic plugs 61 to protect the nuts 58 and bolts 60 from rusting caused by weather. The front wall 50 of the monument 44 has a rectangular indented area 62 therein downwardly of the upper end 46. The rectangular indented area 62 would have names either sandblasted onto the indented area 62 or put in place via an engraved brass plate. The front wall 50 has a plurality of recessed portions 64 formed therein downwardly of the rectangular indented area 62. The front wall 50 has two square indented areas 66 therein downwardly of the plurality of recesses portions 64. The two square indented areas 66 have apertures formed in four corners thereof to allow brass plates or other types of plates to be secured thereto. The monument 44 preferably is a pentagonal in shape with a cross formed at the top. Flowers or decorative scrolling could be sandblasted along edges of the monument 44. After the monument 44 is secured within the base portion 12, a silicon caulking sealant can be applied around the monument 44 where it extends outwardly of the recess 24 in the base portion 12 to prevent water from entering into the recess 24 and causing damage.

The device 10 contains a plurality of clear plastic enclosure inserts 70 adapted for securement within the plurality of recessed portions 66 formed in the front wall 50 of the monument 44. The inserts 70 could contain such items as molded figures, such as angels, sports objects, pet likenesses. Silk flowers could also be encased within the inserts 70 so that they are preserved within the front wall 50 of the monument 44.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A customized memorial for providing a graveside memorial comprising, in combination:

a base portion having a top side, a bottom side, a front wall, a rear wall, and two side walls, the top side having a recess formed therein, the recess having a bottom side, a front side, a rear side, and two sides, the bottom side of the recess having apertures formed through opposing ends thereof extending through the bottom side of the base portion, the rear side and the front side of the recess each having apertures formed through opposing ends thereof extending through the respective front wall and rear wall of the base portion;

a pair of auger-style anchors received through the apertures through opposing ends of the bottom side of the recess and extending outwardly of the bottom side of the base portion, the pair of auger-style anchors securing the base portion into a ground area;

a monument having an upper end, a lower end, a front wall, a rear wall, and two side walls, the monument having a pair of apertures formed through the front wall and extending through the rear wall adjacent to the lower end thereof, the lower end of the monument received within the recess in the base portion, the pair of apertures aligning with the apertures formed in the rear side and front side of the recess the monument secured to the base portion by nuts and bolts through the aligning apertures, the front wall of the monument having a rectangular indented area therein downwardly of the upper end, the front wall having a plurality of recessed portions formed therein downwardly of the rectangular indented area, the front wall having two square indented areas therein downwardly of the plurality of recesses portions;

a plurality of clear plastic enclosure inserts secured within the plurality of recessed portions formed in the front wall of the monument.

2. A customized memorial comprising:

a base portion having a recess formed therein, the base portion having a top side, a bottom side, a front wall, a rear wall, and two side walls, the top side having the recess formed therein, the recess having a bottom side, a front side, a rear side, and two sides, the bottom side of the recess having apertures formed through opposing ends thereof extending through the bottom side of the base portion, the rear side and the front side of the recess each having apertures formed through opposing ends thereof extending through the respective front wall and rear wall of the base portion;

a pair of auger-style anchors securing the base portion into a ground area;

a monument received within the recess in the base portion.

3. The customized memorial as described in claim 2 wherein the pair of auger-style anchors are received through the apertures through opposing ends of the bottom side of the recess and extending outwardly of the bottom side of the base portion.

4. The customized memorial as described in claim 3 wherein the monument having an upper end, a lower end, a front wall, a rear wall, and two side walls, the monument having a pair of apertures formed through the front wall and extending through the rear wall adjacent to the lower end thereof, the lower end of the monument received within the recess in the base portion, the pair of apertures aligning with the apertures formed in the rear side and front side of the recess the monument to be secured to the base portion by nuts and bolts through the aligning apertures, the front wall of the monument having a rectangular indented area therein downwardly of the upper end, the front wall having a plurality of recessed portions formed therein downwardly of the rectangular indented area, the front wall having two square indented areas therein downwardly of the plurality of recesses portions.

5. The customized memorial as described in claim 4 and further including a plurality of clear plastic enclosure inserts secured within the plurality of recessed portions formed in the front wall of the monument.

* * * * *